US011305538B2

(12) United States Patent
Tsutsui

(10) Patent No.: US 11,305,538 B2
(45) Date of Patent: Apr. 19, 2022

(54) METHOD OF MANUFACTURING MICROSTRUCTURE AND METHOD OF MANUFACTURING LIQUID EJECTION HEAD

(71) Applicant: CANON KABUSHIKI KAISHA, Tokyo (JP)

(72) Inventor: Satoshi Tsutsui, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/590,186

(22) Filed: Oct. 1, 2019

(65) Prior Publication Data

US 2020/0108608 A1 Apr. 9, 2020

(30) Foreign Application Priority Data

Oct. 5, 2018 (JP) ..... JP2018-189837

(51) Int. Cl.
*B41J 2/135* (2006.01)
*B41J 2/16* (2006.01)

(52) U.S. Cl.
CPC ..... *B41J 2/1603* (2013.01); *B41J 2/1626* (2013.01); *B41J 2/1631* (2013.01); *B41J 2202/11* (2013.01)

(58) Field of Classification Search
CPC ..... B41J 2/1404; B41J 2/1631; B41J 2/1634
See application file for complete search history.

(56) References Cited

U.S. PATENT DOCUMENTS 8,500,246 B2 * 8/2013 Park ..... B41J 2/1404 347/44
2009/0025221 A1 * 1/2009 Saito ..... B41J 2/1634 29/890.1
2016/0091789 A1 * 3/2016 Horiuchi ..... B41J 2/1631 430/321

FOREIGN PATENT DOCUMENTS

JP 2015-104875 A 6/2015

* cited by examiner

*Primary Examiner* — Lam S Nguyen
(74) *Attorney, Agent, or Firm* — Canon U.S.A., Inc., IP Division

(57) ABSTRACT

A microstructure including a minute structural part is manufactured by transferring a laminate including a photosensitive resin composition onto a substrate having an opening and patterning the laminate. The laminate includes a first layer that includes a first resin composition and a second layer that includes a second resin composition, each of the first and second resin compositions being a negative type photosensitive resin composition including a cationically polymerizable compound having an epoxy group. The laminate is transferred such that the second layer faces the substrate. The first resin composition is in a liquid state and the second resin composition is in a liquid state in the course of transferring the laminate.

21 Claims, 3 Drawing Sheets

METHOD OF MANUFACTURING MICROSTRUCTURE AND METHOD OF MANUFACTURING LIQUID EJECTION HEAD

BACKGROUND OF THE INVENTION

Field of the Invention

The present disclosure relates to a method of manufacturing a microstructure and a method of manufacturing a liquid ejection head using the manufacturing method.

Description of the Related Art

Examples of the microstructure formed by using a photosensitive resin include a liquid ejection head that ejects a liquid. The liquid ejection head is used in a liquid ejection apparatus such as an inkjet recording apparatus and includes a nozzle layer and an element substrate. The nozzle layer is provided on the element substrate, and an ejection orifice that ejects a liquid and a flow path that communicates with the ejection orifice is formed. A liquid supply port that communicates with the flow path is formed in the element substrate, and an energy generating element is disposed on the front surface side on which the nozzle layer is formed. In the liquid ejection head, liquid is supplied from the liquid supply port to the flow path, energy is applied by the energy generating element, and the liquid is ejected from the ejection orifice and lands on a recording medium such as paper.

It is known that a structural part such as a nozzle layer disposed on the substrate is formed of an organic material layer, and particularly, in a case where a photosensitive resin is used, a highly precise microstructure is able to be formed by photolithography.

As a method of manufacturing the liquid ejection head having the above configuration, Japanese Patent Application Laid-Open No. 2015-104875 (Patent Document 1) discloses a method having the following steps. Specifically, first, by transferring a dry film including a photosensitive resin to a substrate on which a liquid supply port is formed, the dry film is brought into contact with a substrate portion exposed at an opening portion of the liquid supply port and protects the substrate. Thereafter, the dry film is patterned into a desired shape, and then the nozzle layer including the flow path and the ejection orifice is formed by using a transfer method using another dry film including a photosensitive resin and photolithography. In that case, a pattern (latent image) of the flow path and a pattern (latent image) of the ejection orifice, which are formed by the exposure, are collectively removed by development.

U.S. Pat. No. 8,500,246 (Patent Document 2) discloses a method of manufacturing an ink jet recording head including the following steps. Specifically, first, a dry film including a flow path forming layer and an adhesion layer which is made of a photosensitive resin material is formed on a substrate including an ink supply port and an ejection pressure generating element, and the exposure and development is collectively (simultaneously) performed, so as to form flow path walls that define a flow path. Next, a photosensitive dry film is laminated on the flow path wall, and is exposed and developed so as to form a nozzle plate having an ejection orifice communicating with the flow path. Here, the flow path wall and the nozzle plate are collectively referred to as a nozzle layer.

Accordingly, it is known that at least a part of the nozzle layer is formed by a transfer method using a dry film. As in the methods described in Patent Documents 1 and 2, in a case where a photosensitive resin is used to form a nozzle layer on a substrate having an opening (a recess or a through hole), the transfer method using a dry film is mainly used.

SUMMARY OF THE INVENTION

The present disclosure is a method of manufacturing a microstructure, the method including steps of: transferring a laminate including a photosensitive resin composition onto a substrate having an opening; and patterning the laminate, wherein the laminate includes a first layer that includes a first resin composition and a second layer that includes a second resin composition, each of the first resin composition and the second resin composition being a negative type photosensitive resin composition containing a cationically polymerizable compound having an epoxy group, and wherein the laminate is transferred such that the second layer faces the substrate and in the step of transferring the laminate, the first resin composition is in a solid state and the second resin composition is in a liquid state.

Further features of the present disclosure will become apparent from the following description of exemplary embodiments with reference to the attached drawings.

DESCRIPTION OF THE EMBODIMENTS

Figure 1A:
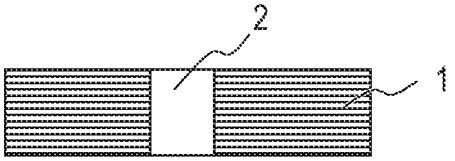
FIGS. 1A, 1B, 1C, 1D, 1E, and 1F are schematic cross-sectional views for describing each step in an embodiment of a method of manufacturing a microstructure according to the present disclosure.

The present inventors have conducted research and compared the film formation of by a liquid resist and the film formation by the dry film by using the photosensitive resin material having the same composition to find the following tendency. That is, from the difference of the wettability to the film formation target (for example, a substrate) at the time of the film formation, the present inventors have found that the structural part obtained by using a dry film had lower adhesion force to a film formation target.

In the method described in Patent Document 1, in order to remove each pattern at one time, development for a long period of time is required. As described above, in a case where the development requires a long period of time, or in the case of using a liquid having a particularly high solvent ratio as the liquid to flow in a flow path, there is tendency in that the decrease of the adhesion force between the film formation target and the structural part using the dry film is noticeable, and thus peeling occurs between both structural parts in some cases.

This tendency is commonly seen also in the method of transferring a photosensitive resin layer to a substrate in which an opening is provided in advance and patterning the layer to manufacture a fine structure body.

An aspect of the present disclosure is to provide a manufacturing method of forming a microstructure including a minute structural part on a substrate including an opening in which bonding reliability between structural parts (layers) is ensured. Another aspect of the present disclosure is to provide a method of manufacturing a liquid ejection head using the manufacturing method of forming a microstructure in which bonding reliability between structural parts of the head is ensured.

In the present disclosure, bonding reliability between structural parts of the microstructure is able to be ensured by transferring the laminate of the specific configuration including the photosensitive resin composition to form the structural part such as a nozzle layer. Specifically, in the present disclosure, the laminate including a first layer which includes a photosensitive resin composition and is in a solid state in a case of transfer and a second layer which includes a resin composition and is in a liquid state in a case of transfer is transferred toward the second layer on the substrate side. That is, the layer in the liquid state is transferred to a transfer target, the wettability to the transfer target is improved, and thus the above aspect is able to be achieved.

Generally, the substrate is configured with an inorganic material such silicon, an inorganic material layer is provided on the substrate surface thereof in many cases, as an insulating layer or a protective layer so as to cover an energy generating element or for various purposes. Therefore, a microstructure such as a liquid ejection head has a structural part such as a substrate including an inorganic material layer and a nozzle layer configured with an organic material layer bonded to the inorganic material layer.

Here, in the bonding of the inorganic material layer and the organic material layer, there is tendency in that the adhesion force therebetween is lower than the adhesion between the organic material layers, and peeling is easily occur due to the low adhesion force. According to the research by the present inventors, it has been found that depending on the material of the inorganic material layer, this tendency becomes more prominent.

Indeed, in Patent Document 2 described above, a nozzle layer made of a photosensitive material which is an organic material is formed on a passivation layer made of silicon nitride which is an inorganic material. Therefore, in a case where a liquid having a high solvent ratio is used, peeling is generated therebetween in some cases. However, as described above, in the present disclosure, since the structural part is formed by using the laminate in a specific configuration, wettability to the inorganic material layer in a case of transfer is able to be improved, and peeling therebetween is able to be suppressed easily. The same effect of the present disclosure can be obtained also in a case where each structural part of the microstructure is configured with an organic material layer.

Hereinafter, an exemplary embodiment of the present disclosure is described with reference to the drawings. In the following description, a configuration including the same function is denoted by the same reference numeral, and the description thereof is omitted in some cases.

<Microstructure and Manufacturing Method Thereof>

Figure 1B:
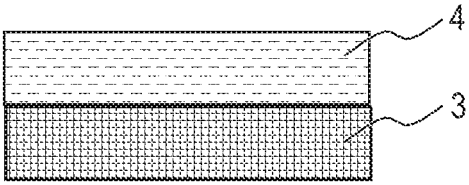
Figure 1C:
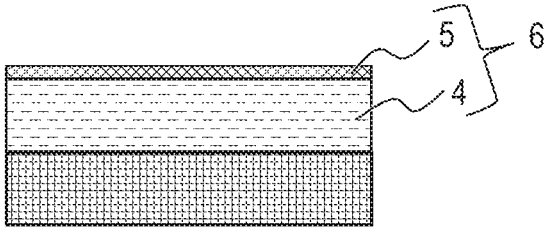
Figure 1D:
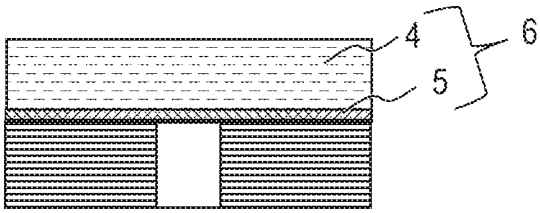
Figure 1E:
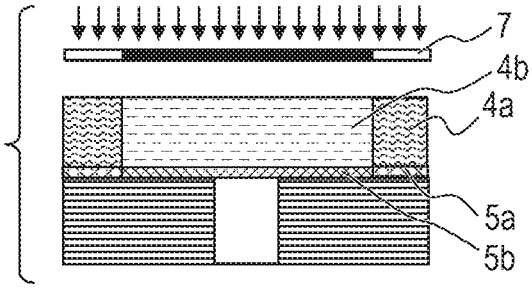
Figure 1F:
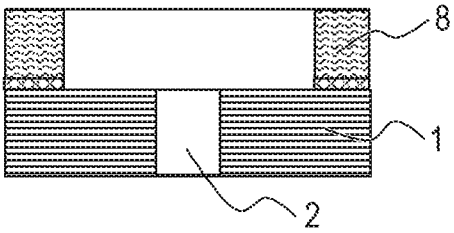

As illustrated in FIG. 1F, in the microstructure obtained by the method of manufacturing the microstructure of the present disclosure, a minute structural part 8 formed by using a laminate including a photosensitive resin composition is disposed on a substrate 1 including an opening 2. The thickness and the shape of the minute structural part 8 are able to be appropriately set according to the manufactured microstructure (for example, the liquid ejection head), and is not particularly limited.

The method of manufacturing the microstructure according to the present disclosure includes the following steps.

A step of transferring a laminate including a photosensitive resin composition to a substrate including an opening (transfer step)

A step of patterning the laminate (patterning step)

The laminate includes a specific first layer and a specific second layer, and in the transfer step, the laminate is transferred with the second layer facing the substrate. The first layer includes a first resin composition exhibiting photosensitivity and is in a solid state in a case of transfer. Meanwhile, the second layer includes a second resin composition and in a liquid state in a case of transfer. With respect to the solid state and the liquid state in a case of transfer according to the present disclosure, a case where the melting point of the resin composition used in the forming of each layer is higher than the temperature of the substrate when transferring is referred to as a solid state, and a case where the melting point is low is referred to as a liquid state.

According to the present disclosure, in addition to these steps, an opening substrate preparing step and a laminate forming step described below are able to be provided. The order of the steps in the method of manufacturing a microstructure according to the present disclosure is not particularly limited, and the steps may be performed sequentially or a plurality of steps (for example, the opening substrate preparing step and the laminate forming step) may be performed in parallel. Hereinafter, each step is specifically provided.

FIGS. 1A to 1F are cross-sectional views for describing each step in an embodiment of a method of manufacturing a microstructure according to the present disclosure.

As illustrated in FIG. 1A, the substrate 1 including the opening 2 is prepared (opening substrate preparing step). The opening may be an opening by a recess or may be an opening penetrating the substrate, but an opening portion may be disposed on the surface on a side to which at least the laminate is transferred. The shape of the opening is not particularly limited, and is able to be set appropriately. The material for configuring the substrate 1 is not particularly limited, and is able to be selected appropriately. For example, a silicon substrate formed of silicon is able to be used. The method of forming the opening 2 in the substrate 1 is not particularly limited. For example, the opening is formed at a desired position by using wet etching with an alkaline etching solution such as tetramethyl ammonium hydroxide (TMAH) or dry etching such as reactive ion etching.

The substrate including an opening is able to include an inorganic material layer. For example, the inorganic material layer is able to include at least one of silicon oxide ($SiO_2$), silicon nitride (SiN), silicon carbide (SiC), silicon carbonitride (SiCN), and metal (for example, Ta or Ir).

Subsequently, as illustrated in FIG. 1B, a film sheet 3 is coated with the first resin composition exhibiting photosensitivity by a spin coating method or a slit coating method, and pre-baked so as to form a first layer 4. The film sheet 3 is able to be configured with polyethylene terephthalate (PET) or polyimide. In view of maintaining the shape of microstructure, the first layer is formed with the first resin composition which is in a solid state in a case of transfer.

Subsequently, as illustrated in FIG. 1C, the first layer 4 is coated with the second resin composition to form a second layer 5 which is in a liquid state in a case of transfer, and a laminate 6 including the photosensitive resin composition is manufactured (laminate forming step). As the coating method with the second resin composition, in view of surface uniformity, coating by a slit coating method is preferable. A photosensitive resin composition is able to be formed by adding a photo or a thermal polymerization initiator (for example, photoacid generator) to the second resin composition. The second layer 5 is able to be configured with the second resin composition. In a case where the second layer which is in a liquid state in a case of transfer, wettability to a transfer target (the substrate 1 in FIGS. 1A to 1F) is improved, and thus bonding reliability between both structural parts is able to be improved.

In the laminate 6, in view of adhesiveness, process resistance, and resolution, it is preferable to cause the thickness of the second layer 5 to be thinner than that of the first layer 4. The total thickness of the laminate 6 is able to be set appropriately depending on the manufactured microstructure.

Subsequently, as illustrated in FIG. 1D, the laminate 6 is transferred to the substrate 1 including the opening 2 with the second layer 5 facing the substrate 1 (transfer step). In this case, the state of the second layer in a case of transfer is able to be changed from a solid state to a liquid state, by transferring the second layer 5 in a solid state at room temperature (for example, 25° C.) to the substrate including an opening under the heating condition, for example, in a state of applying heat to the substrate 1. In this case, the melting point of the used second layer (second resin composition) is higher than the room temperature and lower than the heating temperature. Here, the temperature heating the substrate is not particularly limited, and is able to be set appropriately depending on used materials of the substrate and the laminate. For example, the heating temperature is able to be 30° C. or more to 90° C. or less.

In view of preventing the liquefied second layer from flowing into the opening of the substrate, the viscosity of the second layer (in a case of transfer, for example, at the heating temperature) in a liquid state is preferably 30 mPa·s or more to 500 mPa·s or less. For example, the second layer 5 is in a liquid state at room temperature (for example, 25° C.) or is disposed on the substrate including the opening, while the second layer of the liquid state was in the state without change. However, in that case, the second layer 5 preferably includes the viscosity (for example, 30 to 500 mPa·s described above) in the level capable of maintaining the shape.

In a case where the substrate 1 including an opening includes an inorganic material layer on the surface thereof, in the transfer step, the laminate is able to be transferred to the surface of the inorganic material layer such that the second layer 5 of the laminate 6 is disposed. The effect of the present disclosure is able to be enhanced by bonding the inorganic material layer and the second layer which is an organic material layer. The film sheet 3 is removed (peeled off) by the well-known method in the related art after the transfer of the laminate 6 (not illustrated).

Here, it is preferable that the first resin composition and the second resin composition are negative type photosensitive resin compositions including cationically polymerizable compounds including a cationically polymerizable compound (epoxy resin) including an epoxy group considering the adhesiveness with another structural part, the mechanical strength, the resolution. Examples of the negative type photosensitive resin composition include a photocationic polymerization type epoxy resin composition containing bisphenol A-type and F-type epoxy resins, a phenol novolac epoxy resin, a cresol novolac epoxy resin, and a polyfunctional epoxy resin having an oxycyclohexane skeleton.

These resin compositions preferably include a resin (epoxy resin) including a bifunctional or higher epoxy group, in other words, a resin including two or more epoxy groups (on average) in one molecule. When the first and second resin compositions contain an epoxy resin including a bifunctional or higher functional epoxy group, crosslinking three-dimensionally advances such that desired characteristics are suitably obtained. The first resin composition preferably includes a trifunctional or higher functional epoxy resin, in other words, a resin including three or more epoxy groups (on average) in one molecule. Specifically, the first resin composition preferably includes a bifunctional epoxy resin and a trifunctional or higher functional epoxy resin. In a case of including these resins, crosslinking is able to advance three-dimensionally such that the sensitivity as the photosensitive material is improved.

Here, in view of ensuring tent properties to the substrate including an opening, the first resin composition is required to have a film hardness in which the layer is not deformed even in an uncured state when film formation by transfer or other heating steps. Therefore, it is preferable that the bifunctional or higher functional epoxy resin included in the first resin composition has a high weight average molecular weight (Mw). Specifically, it is preferable that the Mw of the bifunctional or higher functional epoxy resin (for example, a bifunctional epoxy resin) is 5,000 to 100,000. If the Mw of the bifunctional or higher functional epoxy resin is 5,000 or more, excellent film hardness is easily obtained, and thus the first resin composition is able to be prevented easily from being flowing into the opening of the substrate when transfer or other heating steps. Accordingly, the thickness of each layer is able to be easily formed uniformly. Meanwhile, when the Mw of the bifunctional or higher functional epoxy resin is 100,000 or less, the crosslink density of the first resin composition is easily maintained appropriately, and a stable pattern shape is able to be formed easily. The Mw of the resin is able to be calculated in terms of polystyrene by using the gel permeation chromatography (for example, manufactured by Shimadzu). The softening point of the bifunctional or higher functional epoxy resin contained in the first resin composition is preferably 90° C. or more. If the softening point is 90° C. or more, the flowing into the opening as described above is able to be prevented easily.

The trifunctional or higher functional epoxy resin contained in the first resin composition preferably has an epoxy equivalent (g/eq) of less than 500. If the epoxy equivalent is less than 500, appropriate sensitivity is obtained, and appropriate pattern resolution, and appropriate mechanical strength and adhesiveness of a cured product are able to be obtained easily.

In view of the pattern resolution, the epoxy resin contained in the second resin composition also preferably has an epoxy equivalent (g/eq) of less than 500. In view of the pattern resolution, the epoxy equivalent of the epoxy resin included in the second resin composition is preferably less than the epoxy equivalent of the epoxy resin included in the first resin composition. In a case where each resin composition has a plurality of epoxy resins, the epoxy equivalents of all of the epoxy resins included in the second resin composition are less than the maximum epoxy equivalent in the epoxy resin included in the first resin composition. In other words, when the maximum epoxy equivalents of the epoxy resins in the first resin composition and the second resin composition are compared with each other, it is preferable that that of the second resin composition is smaller.

The second resin composition is configured with a plurality of resin components and preferably includes a trifunctional or higher functional epoxy resin. If the trifunctional or higher functional epoxy resin is included, crosslinking three-dimensionally advances and the reactivity is able to be further improved. The first resin composition and the second resin composition are able to contain a polymerization initiator such as a photoacid generator.

Examples of the commercially available epoxy resin that is used for a first resin composition include the following.

"CELLOXIDE 2021," "GT-300 Series," "GT-400 Series," and "EHPE3150" (all are trademarks) manufactured by DAICEL, "jER1031S", "jER1001", "jER1004", "jER1007", "jER1009", "jER1010", "jER1256", "157S70" (all are trademarks) manufactured by Mitsubishi Chemical, "EPICLON N-695", "EPICLON N-865", "EPICLON 4050", "EPICLON 7050" (all are trademarks) manufactured by DIC, "TECHMORE VG3101" and "EPOX-MKR1710" (all are trademarks) manufactured by Printec, "DENACOL Series" (trademark) manufactured by Nagase ChemteX., and "EP-4000 Series" (trademark) manufactured by ADEKA.

Examples of the commercially available epoxy resin used in the second resin composition include "ADEKA RESIN EP Series" and "ADEKA GLYCIROL ED Series" (all are trademarks) manufactured by ADEKA.

Examples of the polymerization initiator such as a photoacid generator that is able to be added to the resin composition in some cases include a sulfonic acid compound, a diazomethane compound, a sulfonium salt compound, an iodonium salt compound, and a disulfone-based compound. All of these are preferably used. Commercially available products of the (photo)polymerization initiator include "ADEKA OPTOMER SP-170", "ADEKA OPTOMER SP-172", and "SP-150" (all are trademarks) manufactured by ADEKA, "BBI-103" and "BBI-102" (all are trademarks) manufactured by Midori Kagaku, "IBPF", "IBCF", "TS-01", and "TS-91" (all are trademarks) manufactured by Sanwa Chemical, "CPI-210", "CPI-300", and "CPI-410" (all are trademarks) manufactured by San-Apro, and "Irgacure 290" (all are trademarks) manufactured by BASF Japan. Two or more of these polymerization initiators are able to be used in a mixture.

Polyols and a silane coupling agent are able to be added to the above resin composition in some cases for the purpose of improving adhesiveness performance. Examples of the commercially available silane coupling agents include "A-187" (trademark) manufactured by Momentive Performance Materials.

A sensitizer such as an anthracene compound, a basic substance such as amines, or an acid generator that generates toluenesulfonic acid of a weak acid (pKa=−1.5 to 3.0) is able to be added to the resin composition described above in some cases, in order to improve the pattern resolution or adjust the sensitivity (exposure amount required for curing). Examples of the commercially available acid generator that generates toluenesulfonic acid include "TPS-1000" (trademark) manufactured by Midori Kagaku and "WPAG-367" (trademark) manufactured by FUJIFILM Wako Pure Chemical.

"SU-8 Series", "KMPR-1000"(all are trademarks) manufactured by KAYAKU MicroChem and "TMMR 52000" and "TMMF 52000" (all are trademarks) manufactured by Tokyo Ohka Kogyo, which are commercially available as negative type resists are able to be used in the resin composition.

Subsequently, as illustrated in FIGS. 1E and 1F, the laminate 6 is patterned in a desired shape (patterning step). Specifically, as illustrated in FIG. 1E, the first layer 4 exhibiting photosensitivity is pattern-exposed via a photo mask 7, a heat treatment (Post-Exposure-Bake) is performed, if necessary. A microstructure includes the minute structural part 8 having a desired shape illustrated in FIG. 1F on the substrate 1 is able to be obtained by the development (removal step).

Here, in a case where the second layer 5 also exhibits photosensitivity, as illustrated in the drawings, the first layer 4 and the second layer 5 are able to be patterned collectively (simultaneously). In the drawings, the first and second layer is formed by using the negative type photosensitive resin composition, exposed portions 4*a* and 5*a* remain as the minute structural part 8, and unexposed portions 4*b* and 5*b* are removed by development.

In a case where the second layer is not photosensitive, for example, if the photoacid generator is caused to be contained in the first resin composition, a portion of the second layer 5 at a desired position is able to be cured at a desired position by an acid generated by the first layer in a case of exposure.

Even if the second layer 5 that is in a liquid state in a case of transfer partially flows into the opening 2, a portion of the second layer that is positioned near the opening portion of the substrate 1 in the patterning step is able to be removed by patterning.

Here, those well-known in a field of a liquid ejection head are able to be used appropriately as the photo mask 7. For example, as the photo mask, one in which a light shielding film such as a chromium film is formed on a substrate including a material such as glass or quartz that transmits light in an exposure wavelength according to a pattern in a desired shape is able to be used. As the exposure device, for example, a projection exposure device including a light source having a single wavelength such as an i-line exposure stepper and a KrF stepper, or a light source having a broad wavelength of a mercury lamp such as a mask aligner MPA-600 Super (trademark, manufactured by Canon) is able to be used.

In the following description, as an example, a case where the method of manufacturing a microstructure according to the present disclosure is applied to the manufacturing of a liquid ejection head is described, but the method of manufacturing a microstructure according to the present disclosure is not limited to the application to the manufacturing of the liquid ejection head.

<Liquid Ejection Head>

The liquid ejection head manufactured by using the method of manufacturing a microstructure according to the present disclosure is able to be mounted on a printer, a copying machine, a facsimile having a communication system, and also an industrial recording device integrally combined with various processing devices.

Figure 2A:
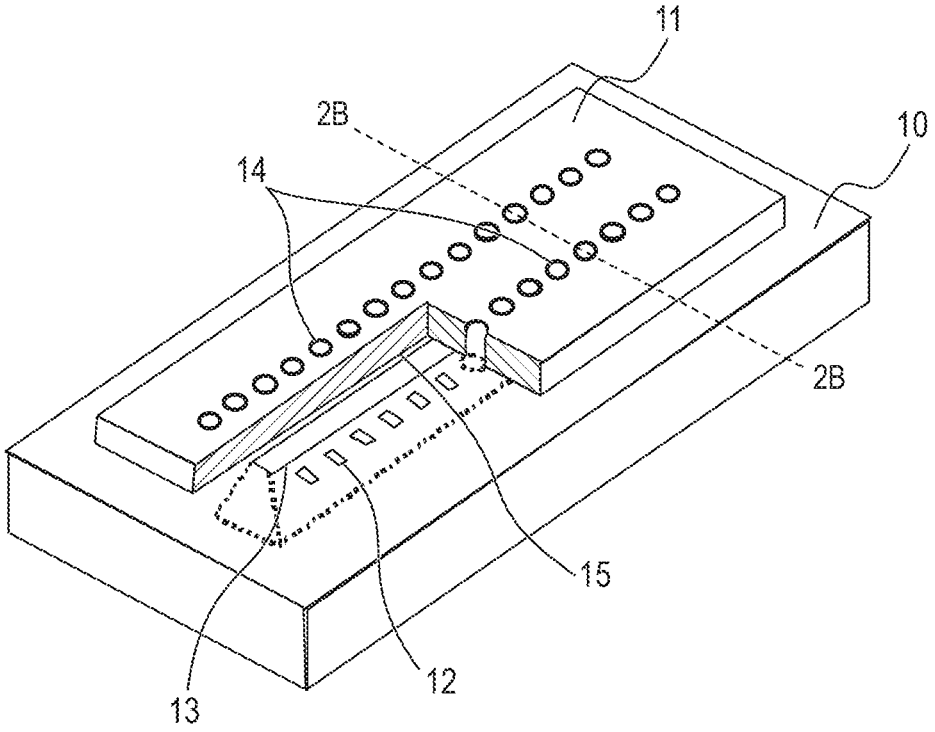
FIG. 2A is a schematic perspective view illustrating the configuration of a liquid ejection head obtained from the embodiment of the present disclosure.
Figure 2B:
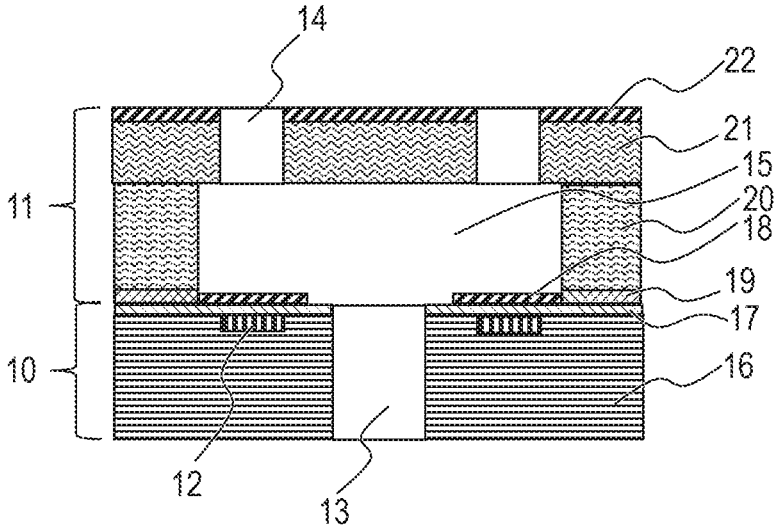
FIG. 2B is a schematic cross-sectional view when the head is cut along line 2B-2B of FIG. 2A.

FIG. 2A illustrates a schematic perspective view of a liquid ejection head obtained according to an embodiment of the present disclosure. FIG. 2B illustrates a schematic cross-sectional view when the liquid ejection head is cut along line 2B-2B in FIG. 2A.

The liquid ejection head illustrated in FIGS. 2A and 2B includes a substrate (element substrate 10) including an energy generating element 12 and a liquid supply port 13, and a nozzle layer 11 including a (liquid) ejection orifice 14 and a (liquid) flow path 15.

(Element Substrate)

As the substrate 16 used in the element substrate 10, for example, a silicon substrate formed with silicon is able to be used. It is preferable that the silicon substrate is a single crystal of silicon, and the crystal orientation of the surface is (100).

The energy generating element 12 only needs to generate energy for ejecting a liquid (for example, a recording liquid such as ink) from the ejection orifice 14. As the energy generating element 12, for example, an electrothermal transducer (a heating resistor element and a heater element) for boiling the liquid and an element (a piezo element or a piezoelectric element) for applying pressure to the liquid by volume change or vibration are able to be used. The number or the disposition of the energy generating elements 12 is able to be appropriately selected according to the structure of the manufactured liquid ejection head. For example, element rows formed by arranging the plurality of elements in a single line at a predetermined pitch are able to be provided respectively on both sides of the liquid supply port 13 on the front surface of the element substrate. The energy generating element 12 may be provided to be in contact with the front surface of the element substrate 10 or may be provided in a state where a part thereof is floated from the front surface of the element substrate 10. The front surface of the element substrate 10 (substrate 16) means the surface on which the nozzle layer 11 is formed, and the surface facing the front surface is the back surface.

The element substrate 10 includes a liquid supply port 13 that is in communication with the flow path 15 so as to supply a liquid. The liquid supply port 13 penetrates the element substrate 10 in a direction substantially perpendicular to the substrate surface, and opens at the front and back surfaces of the element substrate. A control signal input electrode (not illustrated) for operating the energy generating element 12 is able to be provided on the substrate 16.

In the liquid ejection head illustrated in FIGS. 2A and 2B, an insulating layer 17 and a protective layer 18 are formed on the front surface side of the element substrate 10. For example, the insulating layer 17 is able to be formed by using silicon oxide, silicon nitride, silicon carbide, and silicon carbonitride. The protective layer 18 protects the energy generating element 12 and is able to be formed, for example, with Ta or Ir. The insulating layer 17 is able to also function as a heat storage layer, and may or may not cover the surface of the energy generating element 12. In the liquid ejection head illustrated in FIGS. 2A and 2B, the insulating layer 17 is formed on substantially the entire front surface side of the substrate 16. Thus, the element substrate 10 is able to include an inorganic material layer such as the insulating layer 17 or the protective layer 18. As described above, the inorganic material layer is able to include at least one of silicon oxide, silicon nitride, silicon carbide, silicon carbonitride, and metal.

(Nozzle Layer)

The nozzle layer 11 disposed on the element substrate 10 includes the ejection orifice 14 and the flow path 15, and may be configured as a single layer, or may be configured as a plurality of layers. The nozzle layer 11 illustrated in FIG. 2B is configured with an orifice plate including the ejection orifice 14, and the flow-path wall portion including the flow path 15, but the present disclosure is not limited to this form.

The ejection orifice 14 is for ejecting a liquid and is able to be formed, for example, in an orifice plate portion above (upper side of the drawing of) the energy generating element 12 as illustrated in FIG. 2B. The orifice plate includes an ejection orifice forming portion 21 and a liquid repellent layer 22. The flow path 15 communicates with the ejection orifice 14, and the side wall of the flow passage 15 is formed on the insulating layer 17 by a first flow path wall portion 20 and a second flow path wall portion 19.

The liquid ejection head obtained according to the present disclosure ejects the liquid supplied from the liquid supply port 13 through the flow path 15 as droplets from the ejection orifice 14 by the energy generated by the energy generating element 12. Then, recording is able to be performed by causing the droplets to land on a recording medium such as paper.

<Method of Manufacturing Liquid Ejection Head>

The method of manufacturing the liquid ejection head according to the present disclosure uses the method of manufacturing a microstructure described above to manufacture the laminate described above by using at least a part (for example, flow path wall portion) of the nozzle layer 11 on the element substrate 10. Next, each step in the method of manufacturing a liquid ejection head according to the present disclosure is specifically described with reference to FIGS. 3A to 3H. FIGS. 3A to 3H are schematic cross-sectional views for describing each step in an embodiment of the method of manufacturing a liquid ejection head according to the present disclosure and illustrate cross sections of the substrate in each step cut along line 2B-2B in FIG. 2A.

(Opening Substrate Preparating Step)

Figure 3A:
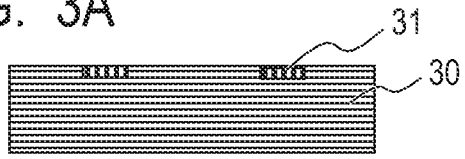
FIGS. 3A, 3B, 3C, 3D, 3E, 3F, 3G, and 3H are schematic cross-sectional views for describing each step in a method of manufacturing a liquid ejection head according to the embodiment of the present disclosure.

First, as illustrated in FIG. 3A, a substrate 30 including an energy generating element 31 on the front surface thereof is prepared.

Figure 3B:
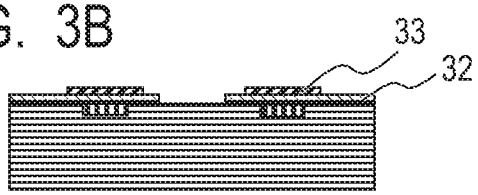

Next, as illustrated in FIG. 3B, an insulating layer 32 and a protective layer 33 are formed on the front surface side of the substrate 30 so as to cover the energy generating elements 31. The protective layer is formed above the energy generating element 31. The insulating layer 32 and the protective layer 33 are patterned, if necessary.

Figure 3C:
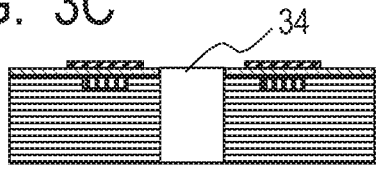

Next, as illustrated in FIG. 3C, a liquid supply port 34 for supplying liquid is formed by penetrating the substrate 30, so as to obtain an element substrate. The liquid supply port 34 is able to be formed at a desired position using wet etching with an alkaline etchant such as TMAH or dry etching such as reactive ion etching.

(Laminate Forming Step of (First Layer and Second Layer))

Next, as illustrated in FIGS. 1B and 1C, by using the first resin composition and the second resin composition exhibiting photosensitivity on the film sheet, a first layer 35 and a second layer 36 are respectively formed so as to manufacture a laminate. The thickness of the laminate, that is, the total thickness of the first layer 35 and the second layer 36 corresponds to the height of the flow path, and thus is able to be appropriately determined according to the ejection design of the liquid ejection head. However, the total thickness is able to be, for example, 3 to 25 μm. In the laminate, the thickness of the second layer 36 is preferably thinner than the thickness of the first layer 35 in view of the adhesiveness, the process resistance, and the resolution. For example, the thickness is able to be 0.5 to 3 μm.

Here, a negative type photosensitive resin composition including a cationically polymerizable compound including an epoxy group is used as the first and second resin compositions forming the first and second layers, respectively. The adhesiveness performance with the orifice plate (particularly, the ejection orifice forming portion), the mechanical strength, stability (resistance) to liquids such as ink, and the resolution as a photolithography material, is able to be easily improved by using such a resin composition. As these resin compositions, those described above in the method of manufacturing a microstructure are able to be appropriately used.

(Transfer Step of (First Layer and Second Layer))

Figure 3D:
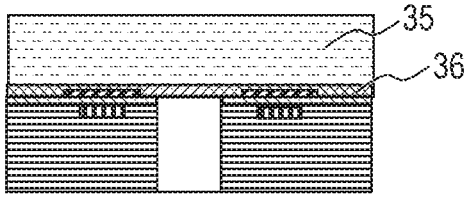

Subsequently, as illustrated in FIG. 3D, the obtained laminate is transferred by a laminating method such that the second layer 36 is disposed on the surface of the inorganic material layer (the insulating layer 32 and the protective layer 33) of the substrate 30 (element substrate) on which the energy generating element 31 and the liquid supply port 34 are disposed. In this case, by performing the transfer step under heating conditions, the second layer 36 in a solid state is able to be changed to the liquid state in a case of transfer. Meanwhile, the first layer 35 continues to be in a solid state even in a case of transfer. The heating temperature in a case of transfer is able to be in the range described above. Although the laminate including the photosensitive resin composition is attached and transferred to the substrate 30 in FIG. 3D, the substrate side may be bonded and transferred to the laminate. The film sheet is appropriately removed from a portion above the first layer by methods well-known in the field of liquid ejection heads (not illustrated).

(Flow Path Pattern Forming Step)

Figure 3E:
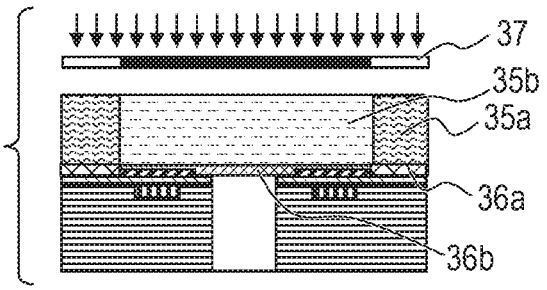

Next, as illustrated in FIG. 3E, the first layer 35 and the second layer 36 are pattern-exposed via a photo mask 37 including a flow path pattern, so as to manufacture the exposed portions 35*a* and 36*a* and unexposed portions 35*b* and 36*b*, such that a flow path pattern is formed. The exposed portion is cured by a heat treatment.

(Transfer Step of (Third Layer))

Next, the film sheet made of PET or polyimide was coated with a third resin composition exhibiting photosensitivity, so as to manufacture a dry film resist in which a third layer 38 is formed on the film sheet (not illustrated). Subsequently, the third layer is transferred onto the first layer 35 of the laminate transferred onto the element substrate by using a laminating method. In view of the adhesiveness performance, the mechanical strength, the liquid (ink) resistance, and the resolution as a photolithographic material of the cured product, it is preferable that the same composition as the first and second resin compositions is used as the third resin composition configuring the third layer. That is, a negative type photosensitive resin composition including the cationically polymerizable compound including an epoxy group described above is preferable.

Among these, in view of the mechanical strength and the resolution of a cured product, the third resin composition preferably includes a trifunctional or higher epoxy resin and a photoacid generator.

The thickness of the third layer is appropriately determined by the ejection design of the liquid ejection head and is not particularly limited. However, in view of mechanical strength, the thickness is preferably 3 to 25 μm.

In FIGS. 3A to 3H, after the first layer and the second layer are exposed, the third layer is laminated on the first layer. However, the third layer may be laminated before the exposure of the first layer.

The third layer may be transferred onto the first layer under heating conditions (for example, in a state where the substrate is heated). However, it is preferable that the heating temperature in this case is 30° C. or more in view of the adhesiveness, and is 70° C. or less in view of the shape stability.

Figure 3F:
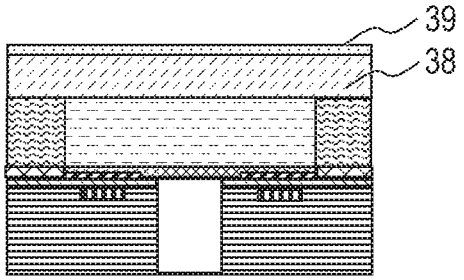

As illustrated in FIG. 3F, a liquid repellent layer 39 is able to be formed on the third layer 38, if necessary. The liquid repellent layer 39 has liquid repellency to a liquid such as ink, and it is preferable to use a perfluoroalkyl composition or a perfluoropolyether composition including cationic polymerization. In general, it is known that in perfluoroalkyl compositions and perfluoropolyether compositions, fluorinated alkyl chains are segregated at the interface between the composition and air by baking after coating, and thus it is possible to improve the liquid repellency of the composition.

(Ejection Orifice Pattern Forming Step)

Figure 3G:
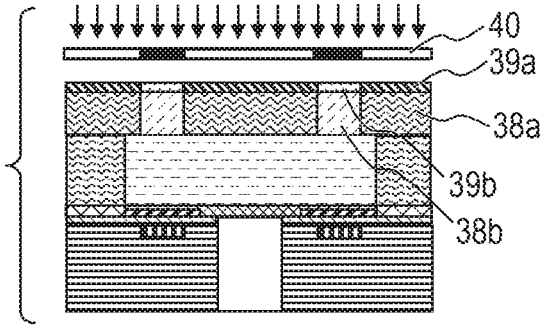

Next, as illustrated in FIG. 3G, the third layer 38 and the liquid repellent layer 39 are pattern-exposed via a photo mask 40 including an ejection orifice pattern, so as to manufacture exposed portions 38*a* and 39*a* and non-exposed portions 38*b* and 39*b*, such that an ejection orifice pattern is formed. Further, the exposed portion is cured by a heat treatment. Here, when the third layer is exposed by using light having the same wavelength as the first layer 35, the exposure amount applied to the third layer is smaller than the exposure amount for curing the first layer. That is, when the third layer 38 is exposed, if the exposure amount of the light transmitted through the third layer is an exposure amount to cure the first layer, it is considered that it becomes difficult to remove an unexposed portion of the first layer in the pattern removing step (developing step) described below. From this, the exposure sensitivity of the third layer is preferably higher than the exposure sensitivity of the first layer.

The photo mask 40 for forming the ejection orifice may be formed by forming a light shielding film such as a chromium film according to the pattern of the ejection orifice on a substrate made of a material such as glass or quartz that transmits light having the exposure wavelength. As the exposure device, a projection exposure device including a light source having a single wavelength such as an i-line exposure stepper and a KrF stepper or a light source having a broad wavelength of a mercury lamp such as a mask aligner MPA-600 Super (trademark, manufactured by Canon) is able to be used.

(Pattern Removing Step)

Figure 3H:
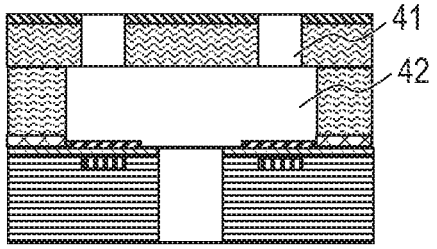

Next, as illustrated in FIG. 3H, the flow path pattern and the ejection orifice pattern, that is, the unexposed portions 35*b*, 36*b*, 38*b*, and 39*b* are collectively (simultaneously) developed with a developing solution to remove the unexposed portions collectively, so as to form the flow path 42 and the ejection orifice 41. In this case, a heat treatment may be performed, if necessary. As a developer, propylene glycol monomethyl ether acetate (PGMEA), methyl isobutyl ketone (MIBK), or xylene is able to be used. Moreover, a rinse treatment with isopropyl alcohol (IPA) may be performed. Accordingly, a liquid ejection head is able to be obtained.

EXAMPLE

The present disclosure will be more specifically described by the following examples, but the present invention is not limited to these examples.

Examples 1 to 7

For each example, a laminate was manufactured by using the first resin composition having the formulation presented in Tables 1 and 2 below and the second resin composition in the liquid state in a case of transfer. Then, a liquid ejection head using a laminate of the above formulation was manufactured by the manufacturing method illustrated in FIGS. 3A to 3H.

TABLE 1

First resin composition

| Component | Trademark | Weight average molecular weight (MW) | Epoxy equivalent (g/eq) | | Example 1 | 2 | 3 | 4 | 5 | 6 | 7 |
|---|---|---|---|---|---|---|---|---|---|---|---|
| Trifunctional or higher functional epoxy resin | EPICLON N-695 | 3400 | 214 | Compounding amount (parts by mass) | 100 | 100 | 100 | 100 | 100 | 100 | 100 |
| Bifunctional epoxy resin | jER1007 | 11200 | 1975 | | 50 | 50 | 50 | 50 | 30 | — | — |
| | jER1009 | 22700 | 2850 | | — | — | — | — | — | 20 | — |
| | jER1256 | 58000 | 8000 | | — | — | — | — | — | — | 10 |
| Photoacid generator | CPI-410S | — | — | | 1.5 | 1.5 | 1.5 | 1.5 | 1.5 | 1.5 | 1.5 |
| | SP-172 | — | — | | 3.3 | 3.3 | 3.3 | 3.1 | 3.0 | 4.0 | 5.8 |
| Acid generator | TPS-1000 | — | — | | 0.5 | 0.5 | 0.5 | 0.5 | 0.4 | 0.5 | 0.6 |
| Silane coupling agent | A-187 | — | — | | 5.0 | 5.0 | 5.0 | 5.0 | 5.0 | 5.0 | 5.0 |
| Solvent | PGMEA | — | — | | 120 | 120 | 120 | 120 | 110 | 110 | 100 |
| Film thickness (μm) | | | | | 15.0 | 15.0 | 15.0 | 15.0 | 15.0 | 15.0 | 15.0 |

TABLE 2

Second resin composition

| Component | Trademark | Epoxy equivalent (g/eq) | | Example 1 | 2 | 3 | 4 | 5 | 6 | 7 |
|---|---|---|---|---|---|---|---|---|---|---|
| Epoxy resin | EP-4088 | 230 | Compounding amount (parts by mass) | 100 | 70 | — | 100 | 100 | 100 | 100 |
| | ED-505 | 150 | | — | 30 | 100 | — | — | — | — |
| Photoacid generator | SP-172 | — | | — | — | — | 1.5 | — | — | — |
| Film thickness (μm) | | | | 2.0 | 1.0 | 0.5 | 1.0 | 1.0 | 1.0 | 1.0 |

First, as illustrated in FIG. 1B, a 100 μm thick PET film was coated with the first resin composition having the formulation presented in Table 1 by spin coating, was baked at 90° C. for 10 minutes to volatilize the PGMEA solvent such that a 15.0 μm film as a first layer was formed.

Next, as illustrated in FIG. 1C, the first layer was coated with the second resin composition having the formulation presented in Table 2 by a slit coating method so as to form a second layer, such that a laminate was manufactured.

Next, as illustrated in FIG. 3A, a substrate 30 formed of silicon including the energy generating element 31 made of TaSiN on the front surface side was prepared.

Next, as illustrated in FIG. 3B, SiCN was deposited in a thickness of 1.0 μm by a plasma CVD method as the insulating layer 32 on the front surface side of the substrate 30 so as to cover the energy generating elements 31. Subsequently, Ta was formed to a thickness of 0.25 μm as the protective layer 33 by a sputtering method. Furthermore, an etching mask of a desired shape was formed on the protective layer by photolithography, and these inorganic material layers were patterned by reactive ion etching through the etching mask.

Next, as illustrated in FIG. 3C, the liquid supply port 34 penetrating the substrate was formed. Specifically, an etching mask (not illustrated) having a desired shape was formed on the back surface of the substrate by using OFPR (trademark, manufactured by Tokyo Ohka Kogyo Co., Ltd.) which is a positive photosensitive resin, and the liquid supply port was formed by reactive ion etching via this etching mask. The reactive ion etching was performed by the Bosch process using an ICP etching device (manufactured by Alcatel, model number: 8E). After the formation of the liquid supply port 34, the etching mask was removed by using a stripping solution. The etching may be performed from the surface of the substrate.

Next, as illustrated in FIG. 3D, the first layer 35 and the second layer 36 were formed on the substrate. Specifically, while the heat of 70° C. was applied, the laminate was transferred by a laminating method to the surface of the inorganic material layer of the substrate in which the liquid supply port 34 was formed such that the second layer of the laminate manufactured above was disposed. Thereafter, the PET film was peeled off by a peeling tape from the laminate transferred onto the inorganic material layer of the substrate (not illustrated). In each of the examples, the first layer 35 was in a solid state, and the second layer 36 was in a liquid state before the transfer (at normal temperature (25° C.)) and in a case of transfer.

Next, as illustrated in FIG. 3E, the first layer 35 (and the second layer 36) was pattern-exposed via the photo mask 37 including a flow path pattern in an exposure amount of 10,000 J/m$^2$, by using an i-line exposure stepper (manufactured by Canon, trade name: i5). Further, the heat treatment was performed at 50° C. for five minutes so as to cure the exposed portion 35*a* (and 36*a*). In a case where the second layer does not include a photoacid generator, a portion of the second layer to be the flow path wall was cured by an acid generated when the first layer is exposed, so as to form a flow path pattern.

Next, as illustrated in FIG. 3F, the third layer 38 and the liquid repellent layer 39 were formed on the flow path pattern. Specifically, first, the PET film having a thickness of 100 μm was coated with the third resin composition presented in Table 3, baked at 90° C. for five minutes so as to volatilize the solvent, the film having a thickness of 10 μm was formed, so as to manufacture a dry film resist. Next, this dry film resist was transferred and laminated on the flow path pattern by using a lamination method while heat of 50° C. was applied. Thereafter, the PET film was peeled off from the dry film resist transferred onto the flow path pattern by a peeling tape (not illustrated). Subsequently, the third layer 38 was coated with a perfluoropolyether composition having cationic polymerization by using a slit coating method so as to form a liquid repellent layer 39.

TABLE 3

| Third resin composition | | |
|---|---|---|
| Component | Trademark | Compounding amount (parts by mass) |
| Epoxy resin | 157S70 | 100 |
| Photoacid generator | CPI-410S | 0.5 |
| Silane coupling agent | A-187 | 5.0 |
| Solvent | PGMEA | 140 |

Next, as illustrated in FIG. 3G, the third layer 38 and the liquid repellent layer 39 were pattern-exposed by using an i-line exposure stepper (manufactured by Canon, trade name: i5) in an exposure amount of 1,100 J/$m^2$, via the photo mask 40 including an ejection orifice pattern. The exposed portions 38*a* and 39*a* were cured by performing a heat treatment at 90° C. for five minutes so as to form an ejection orifice pattern.

Next, as illustrated in FIG. 3H, the unexposed portions 35*b*, 36*b*, 38*b*, and 39*b* were collectively removed by being developed with PGMEA for one hour and were cured by heat at 200° C., so as to obtain a liquid ejection head including a flow path 42 and an ejection orifice 41.

In each example, after the third layer was laminated, the sagging amount of the entire resin composition layer into the liquid supply port 34 was measured. Here, an amount in which the outermost surface of the third layer positioned at the upper part of the liquid supply port was recessed toward the liquid supply port compared to the other portions was measured to obtain the sagging amount. Specifically, by using a laser microscope (manufactured by Keyence, trademark: VD-9710), the height difference at the outermost surface of the third layer (the height difference of the outermost surface of the third layer above the liquid supply port with respect to the outermost surface of the other portion) was measured and was taken as the sagging amount in the liquid supply port. In all of the liquid ejection heads manufactured in the respective examples, all of the sagging amounts were less than 0.5 μm.

Comparative Examples 1 to 4

Liquid ejection heads according to Comparative Examples 1 to 4 were manufactured in the same manner as in Example 1 except that laminates were manufactured by using the first resin composition and the second resin composition in the formulation presented in Tables 4 and 5.

In Comparative Examples 1, 3, and 4, the first layer in a solid state in a case of transfer was transferred toward the substrate side without forming the second layer. Moreover, with respect to Comparative Example 2, in the manufacturing of this laminate, after coating with the second resin composition, a heat treatment was performed at 90° C. for 60 minutes so as to cure the second resin composition. Therefore, in Comparative Example 2, the second layer was in a solid state when the laminate including the first layer and the second layer was transferred to the substrate.

In the liquid ejection heads manufactured in Comparative Examples 1 to 4, peeling occurred at a portion between the flow path wall portion and the inorganic material layer such as the insulating layer and the protective layer in a case of development.

The sagging amount of the entire resin composition layer in the liquid supply port was measured by using a laser microscope (manufactured by Keyence Corporation, trademark: VD-9710) in the same manner as in the above example. As a result, in the liquid ejection heads of Comparative Examples 1 and 2, the sagging amount was less than 0.5 μm, but in the liquid ejection heads of Comparative Examples 3 and 4, the sagging amount was 1.5 μm or more.

TABLE 4

| First resin composition | | | | | | | | |
|---|---|---|---|---|---|---|---|---|
| | | Weight average molecular | Epoxy equivalent | | Comparative Example | | | |
| Component | Trademark | weight (MW) | (g/eq) | | 1 | 2 | 3 | 4 |
| Trifunctional or higher functional epoxy resin | EPICLON N-695 | 3400 | 214 | Compounding amount (parts by mass) | 100 | 100 | 100 | 100 |
| Bifunctional epoxy resin | jER1001 | 3030 | 480 | | — | — | — | 50 |
| | jER1007 | 11200 | 1975 | | 50 | 50 | — | — |
| Photoacid generator | CPI-410S | — | — | | 1.5 | 1.5 | 1.5 | 1.5 |
| | SP-172 | — | — | | 3.3 | 3.3 | 2.0 | 2.5 |
| Acid generator | TPS-1000 | — | — | | 0.5 | 0.5 | 0.2 | 0.3 |
| Silane coupling agent | A-187 | — | — | | 5.0 | 5.0 | 5.0 | 5.0 |
| Solvent | PGMEA | — | — | | 120 | 120 | 100 | 120 |
| Film thickness (μm) | | | | | 15.0 | 15.0 | 15.0 | 15.0 |

TABLE 5

| Second resin composition | | | | | | | |
|---|---|---|---|---|---|---|---|
| | | Epoxy equivalent | | Comparative Example | | | |
| Component | Trademark | (g/eq) | | 1 | 2 | 3 | 4 |
| Epoxy resin | EP-4088 | 230 | Compounding amount (parts by mass) | — | 100 | — | — |
| Acid generator | CP-77 | — | | — | 1.5 | — | — |
| Film thickness (μm) | | | | — | 1.0 | — | — |

Each component presented in Tables 1 to 5 represents the following. (Epoxy resin)

EPICLON N-695 (trademark, manufactured by DIC)
jER1001, jER1007, jER1009 and jER1256 (all are trademarks, manufactured by Mitsubishi Chemical)
ADEKA RESIN EP-4088 (trademark, manufactured by ADEKA)
ADEKA GLYCIROL ED-505 (trademark, manufactured by ADEKA)
157S70 (trademark, manufactured by Mitsubishi Chemical) (Acid generator)
CPI-410S (trademark, manufactured by San-Apro)
ADEKA OPTOMER SP-172 (trademark, manufactured by ADEKA)
ADEKA OPTON CP-77 (trademark, manufactured by ADEKA)
TPS-1000 (trademark, manufactured by Midori Kagaku) Silane coupling agent
A-187 (trademark, manufactured by Momentive Performance Materials Inc.)

[Evaluation]

<Peeling Resistance>

The flow paths of the liquid ejection heads manufactured in Examples 1 to 7 and Comparative Examples 1 to 4 were filled with the inks presented in Table 6, and left in an oven at 70° C. for 90 days. Carbon black was used as a black pigment.

TABLE 6

| Compounding component | Part by mass |
|---|---|
| Diethylene glycol | 10.0 |
| 2-pyrrolidone | 30.0 |
| 1,2-hexanediol | 7.0 |
| Acetylenol | 1.0 |
| Black pigment | 3.0 |
| Pure water | 49.0 |

The bonding state of the inorganic material layer after the leaving and the flow path wall portion was observed with a metallurgical microscope (trade name: MX63L, manufactured by Olympus Corporation), and the evaluation was performed based on the following criteria.

Evaluation criteria

○: Peeling did not occur between the inorganic material layer and the flow path wall portion even after storage at 70° C. for 90 days.

x: Peeling which was not observed when the liquid ejection head was completed occurred between the inorganic material layer and the flow path wall portion after storage at 70° C. for 90 days.

<Print Evaluation (Print Quality)>

Each liquid ejection head manufactured in each example and comparative example was filled with ink made of ethylene glycol/urea/isopropyl alcohol/N-methylpyrrolidone/black dye (C. I. Food Black 2)/water=5/3/2/5/3/82. Then, before and after the liquid ejection head was stored at 70° C. for 90 days, a printed matter (lined line printing, dot printing) was manufactured, and the printing evaluation was performed according to the following evaluation criteria.

Evaluation criteria

Good: No difference was observed in the manufactured printed matter before and after storage at 70° C. for 90 days.

Defective: Deflection was seen in the manufactured printed matter after storage at 70° C. for 90 days.

Evaluation results of the peel resistance and the print quality are presented in Table 7.

TABLE 7

| | Example | | | | | | | Comparative Example | | | |
|---|---|---|---|---|---|---|---|---|---|---|---|
| Evaluation item | 1 | 2 | 3 | 4 | 5 | 6 | 7 | 1 | 2 | 3 | 4 |
| Peeling resistance | ○ | ○ | ○ | ○ | ○ | ○ | ○ | x | x | x | x |
| Print quality | Good | Good | Good | Good | Good | Good | Good | Defective | Defective | Defective | Defective |

In the liquid ejection heads manufactured in Examples 1 to 7, the peeling resistance of the inorganic material layer and the flow path wall portion was good, and the print quality was also good. Meanwhile, in the liquid ejection heads manufactured in Comparative Examples 1 to 4, the peeling resistance was low, and the print quality was deteriorated due to the occurrence of peeling between the inorganic material layer and the flow path wall portion. In Comparative Examples 3 and 4, since the sagging of the entire resin composition layer to the supply port was larger than that in Comparative Examples 1 and 2, the deterioration in print quality was more remarkable than that in Comparative Examples 1 and 2.

As described above, it was known that, according to the present disclosure, it is possible to provide a method of manufacturing a microstructure using a substrate including an opening including a bonding reliability between structural parts and a method of manufacturing a liquid ejection head using this manufacturing method.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structure bodies and functions.

This application claims the benefit of Japanese Patent Application No. 2018-189837, filed Oct. 5, 2018, which is hereby incorporated by reference herein in its entirety.

What is claimed is:

1. A method of manufacturing a microstructure, the method comprising steps of:

transferring a laminate including a photosensitive resin composition onto a substrate having an opening; and patterning the laminate, wherein the laminate includes a first layer that includes a first resin composition and a second layer that includes a second resin composition, each of the first resin composition and the second resin composition being a negative type photosensitive resin composition containing a cationically polymerizable compound having an epoxy group, and wherein the laminate is transferred such that the second layer faces the substrate and in the step of transferring the laminate, the first resin composition is in a solid state and the second resin composition is in a liquid state.

2. The method of manufacturing a microstructure according to claim 1, wherein each of the first resin composition and the second resin composition contains a bifunctional or higher functional epoxy resin.

3. The method of manufacturing a microstructure according to claim 1, wherein an epoxy equivalent of the cationically polymerizable compound contained in the second resin composition is less than that of the cationically polymerizable compound contained in the first resin composition.

4. The method of manufacturing a microstructure according to claim 1, wherein the first resin composition contains a bifunctional epoxy resin and a trifunctional or higher functional epoxy resin.

5. The method of manufacturing a microstructure according to claim 4, wherein a weight average molecular weight (Mw) of the bifunctional epoxy resin is 5,000 to 100,000.

6. The method of manufacturing a microstructure according to claim 1, wherein the first resin composition contains a photoacid generator.

7. The method of manufacturing a microstructure according to claim 1, wherein a thickness of the second layer is thinner than a thickness of the first layer in the laminate.

8. The method of manufacturing a microstructure according to claim 1, wherein the substrate having an opening includes an inorganic material layer.

9. The method of manufacturing a microstructure according to claim 8, wherein the inorganic material layer contains at least one member selected from the group consisting of silicon oxide, silicon nitride, silicon carbide, silicon carbonitride, and metal.

10. The method of manufacturing a microstructure according to claim 8, wherein the laminate is transferred such that the second layer of the laminate is disposed on a surface of the inorganic material layer included in the substrate.

11. The method of manufacturing a microstructure according to claim 1, wherein in the step of transferring the laminate, the second layer in a solid state is disposed on the substrate having an opening under heated condition, whereby the second layer is changed to a liquid state.

12. The method of manufacturing a microstructure according to claim 1, wherein in the step of transferring the laminate, a viscosity of the second layer in a liquid state as transferred onto the substrate having an opening is 30 mPa·s or more and 500 mPa·s or less.

13. The method of manufacturing a microstructure according to claim 1, wherein in the step of patterning the laminate, a portion of the second layer that is positioned near the opening of the substrate is removed.

14. The method of manufacturing a microstructure according to claim 1, wherein, during the transferring, the substrate is at a transfer temperature, and wherein a melting point of the second resin composition is lower than the transfer temperature.

15. A method of manufacturing a liquid ejection head including a nozzle layer that has an ejection orifice for ejecting liquid and a flow path that communicates with the ejection orifice, and an element substrate that has an energy generating element configured to generate energy for ejecting liquid from the ejection orifice and a liquid supply port which communicates with the flow path for supplying liquid, the method comprising steps of:

transferring a laminate including a photosensitive resin composition onto the element substrate; and patterning the laminate, wherein the laminate includes a first layer that includes a first resin composition and a second layer that includes a second resin composition, each of the first resin composition and the second resin composition being a negative type photosensitive resin composition containing a cationically polymerizable compound having an epoxy group, and wherein the laminate is transferred such that the second layer faces the substrate and in the step of transferring the laminate, the first resin composition is in a solid state and the second resin composition is in a liquid state, and wherein at least a portion of the nozzle layer is manufactured by using the laminate.

16. The method of manufacturing a liquid ejection head according to claim 15, further comprising a step of:

transferring a third layer that includes a third resin composition having photosensitivity onto the first layer of the laminate transferred onto the element substrate.

17. The method of manufacturing a liquid ejection head according to claim 16, wherein the third resin composition contains a trifunctional or higher functional epoxy resin and a photoacid generator.

18. The method of manufacturing a liquid ejection head according to claim 16, comprising steps of:

forming a pattern of the flow path by exposing the laminate; and forming a pattern of the ejection orifice by exposing the third layer.

19. The method of manufacturing a liquid ejection head according to claim 18, further comprising a step of:

developing the pattern of the flow path and the pattern of the ejection orifice collectively to form the flow path and the ejection orifice at the same time.

20. The method of manufacturing a liquid ejection head according to claim 18, wherein exposure sensitivity of the third layer is higher than exposure sensitivity of the first layer.

21. The method of manufacturing a liquid ejection head according to claim 19, wherein exposure sensitivity of the third layer is higher than exposure sensitivity of the first layer.

* * * * *